US006106253A

United States Patent [19]

Sakai et al.

[11] Patent Number: 6,106,253

[45] Date of Patent: Aug. 22, 2000

[54] SCROLL TYPE COMPRESSOR FOR GAS-INJECTION TYPE REFRIGERATING CYCLE

[75] Inventors: Takeshi Sakai, Chiryu; Takeshi Wakisaka, Nagoya, both of Japan

[73] Assignee: DENSO Corporation, Kariya, Japan

[21] Appl. No.: 09/089,642

[22] Filed: Jun. 3, 1998

[30] Foreign Application Priority Data

Jun. 4, 1997 [JP] Japan ..... 9-146635

[51] Int. Cl.[7] ..... F01C 1/02

[52] U.S. Cl. ..... 418/55.6; 418/99

[58] Field of Search ..... 418/55.6, 99

[56] References Cited

U.S. PATENT DOCUMENTS 5,103,652 4/1992 Mizuno et al. ..... 418/55.6 X
5,447,420 9/1995 Caillat et al. ..... 418/55.6 X
5,720,602 2/1998 Hill et al. ..... 418/55.6 X
5,810,573 9/1998 Mitsunaga et al. ..... 418/55.6

FOREIGN PATENT DOCUMENTS 62-3184 1/1987 Japan .

*Primary Examiner*—Hoang Nguyen
*Attorney, Agent, or Firm*—Pillsbury Madison & Sutro LLP

[57] ABSTRACT

In a scroll type compressor to be applied to a gas-injection type refrigerating cycle, an injection port is formed in a pressure receiving surface of a front housing, and a communication port is formed in a pressure transmitting surface of a movable scroll member. A spacer is provided between the pressure receiving surface and the pressure transmitting surface, and is fixed to the pressure receiving surface. The spacer has a penetration hole at a position corresponding to the injection port formed in the pressure receiving surface.

8 Claims, 4 Drawing Sheets

SCROLL TYPE COMPRESSOR FOR GAS-INJECTION TYPE REFRIGERATING CYCLE

CROSS REFERENCE TO RELATED APPLICATION

This application is based on and incorporates herein by reference Japanese Patent Application No. Hei. 9-146635 filed on Jun. 4, 1997.

BACKGROUND OF THE INVENTION

1. Field of the Invention

The present invention relates to a scroll type compressor to be applied to a gas-injection type refrigerating cycle in which a part of refrigerant pressure-reduced by a pressure-reducing unit is injected into a compression chamber of the compressor.

2. Description of Related Art

A scroll type compressor applied to a gas-injection type refrigerating cycle is disclosed in Japanese Patent Unexamined Publication No. 62-3184. In this scroll type compressor, an injection port through which a medium pressure refrigerant is injected is formed in a fixed scroll member. The medium pressure refrigerant is injected into a compression chamber via a movable scroll member and the injection port. An injection timing of the medium pressure refrigerant is adjusted by communicating the injection port with the compression chamber intermittently in accordance with an orbit of the movable scroll member.

In a scroll type compressor, a compression reaction force functions on a movable scroll member to separate the movable scroll member away from a fixed scroll member. Thus, in the scroll compressor disclosed in the above reference, a gap arises between both scroll members by this compression reaction force, and the medium pressure refrigerant leaks through this gap to a side of low pressure. As a result, the compressor does not achieve a sufficiently high coefficient of performance.

SUMMARY OF THE INVENTION

An object of the present invention is to provide a scroll type compressor to be applied to a gas-injection type refrigerating cycle, in which a medium pressure refrigerant is prevented from leaking to a low pressure side.

According to a first aspect of the present invention, an injection port is formed in a pressure receiving surface, and a communication port is formed in a pressure transmitting surface. While a scroll type compressor operates, the thrust load due to the compression reaction force functions on the pressure receiving surface and the pressure transmitting surface. Thus these surfaces are hermetically contacted to each other. In the present invention, the injection port and the communication port are formed in the pressure receiving surface and the pressure transmitting surface respectively. Therefore, no gap arises between the injection port and the communication port. As a result, the medium pressure refrigerant is prevented from leaking to the side of low pressure, and a coefficient of performance of the injection type refrigerating cycle is sufficiently improved.

According to a second aspect of the present invention, a spacer is provided between the pressure receiving surface and the pressure transmitting surface. The spacer contacts the pressure receiving surface and the pressure transmitting surface, and is fixed to one of them. The spacer has a penetration hole at a position corresponding to one of the ports formed in the one of surfaces to which the spacer is fixed. Thus, injection timing can be easily adjusted by changing the shape or the location of the penetration hole of the spacer. That is, the shape or the location of the injection port and the communication port do not need to be changed.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PREFERRED EMBODIMENTS

Figure 1:
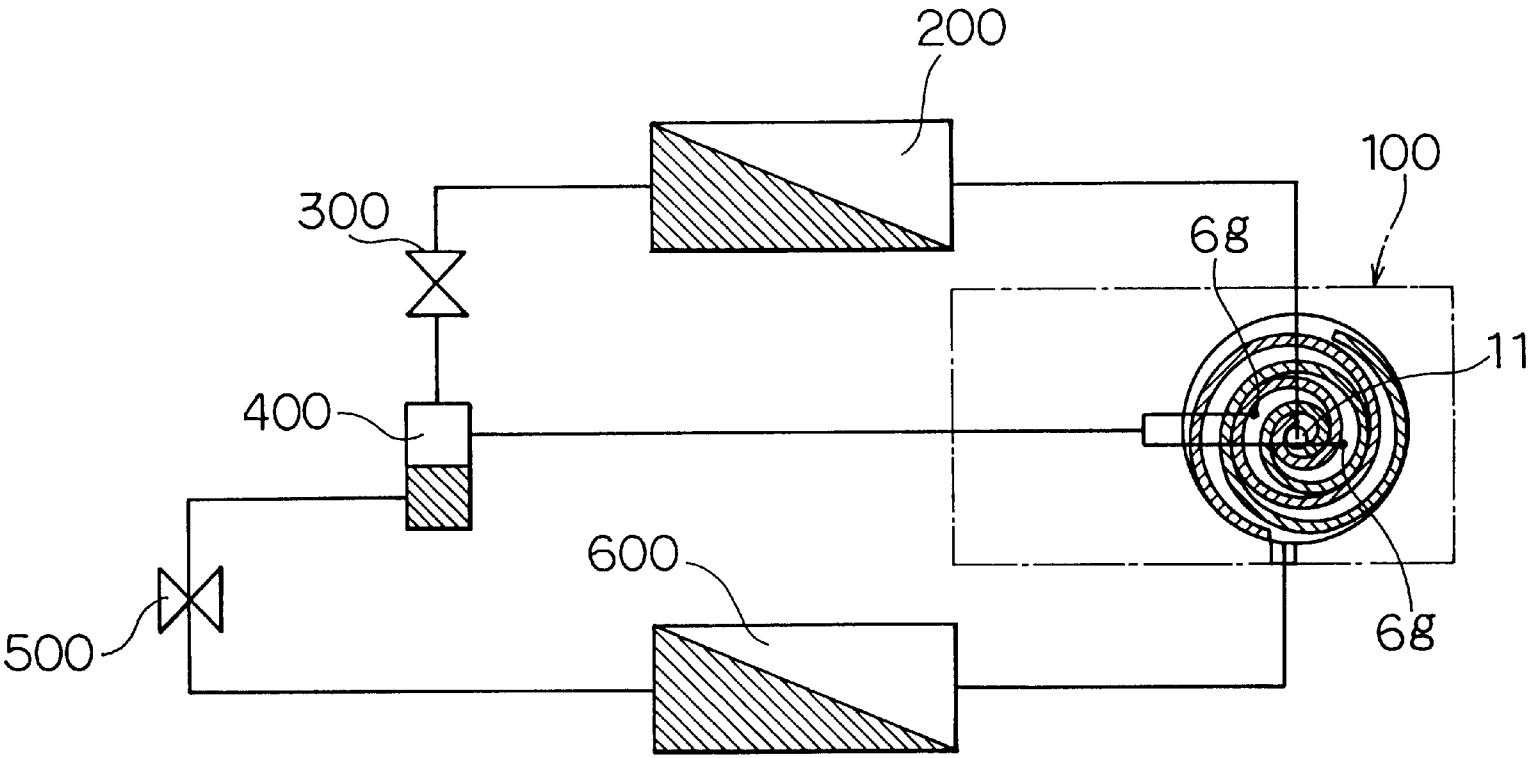
FIG. 1 is a schematic view showing a gas-injection type refrigerating cycle.

Referring to the drawings, preferred embodiments of the present invention will be described.

A scroll type compressor 100 is applied to a gas-injection type refrigerating cycle. Gas refrigerant is compressed and discharged by the compressor 100 and introduced into a condenser 200. The gas refrigerant is condensed (cooled) in the condenser (gas cooler) 200 and becomes liquid refrigerant. The liquid refrigerant is pressure-reduced by a first throttle valve (first pressure-reducing unit) 300 and becomes gas-liquid refrigerant. The gas-liquid refrigerant pressure-reduced by the first throttle valve is separated into gas refrigerant and the liquid refrigerant in a gas-liquid separator 400.

The liquid refrigerant separated in the gas-liquid separator 400 is pressure-reduced again by a second throttle valve (second pressure-reducing unit) 500 and becomes fog-like refrigerant. The fog-like refrigerant flows into an evaporator 600 and evaporates into vaporized gas refrigerant. The gas refrigerant is suctioned into the compressor 100 and compressed therein.

The gas refrigerant separated in the gas-liquid separator 400 is injected into the compression chamber 10 of the compressor 100 through an injection hole 6*g* provided in the compressor 100.

Figure 2:
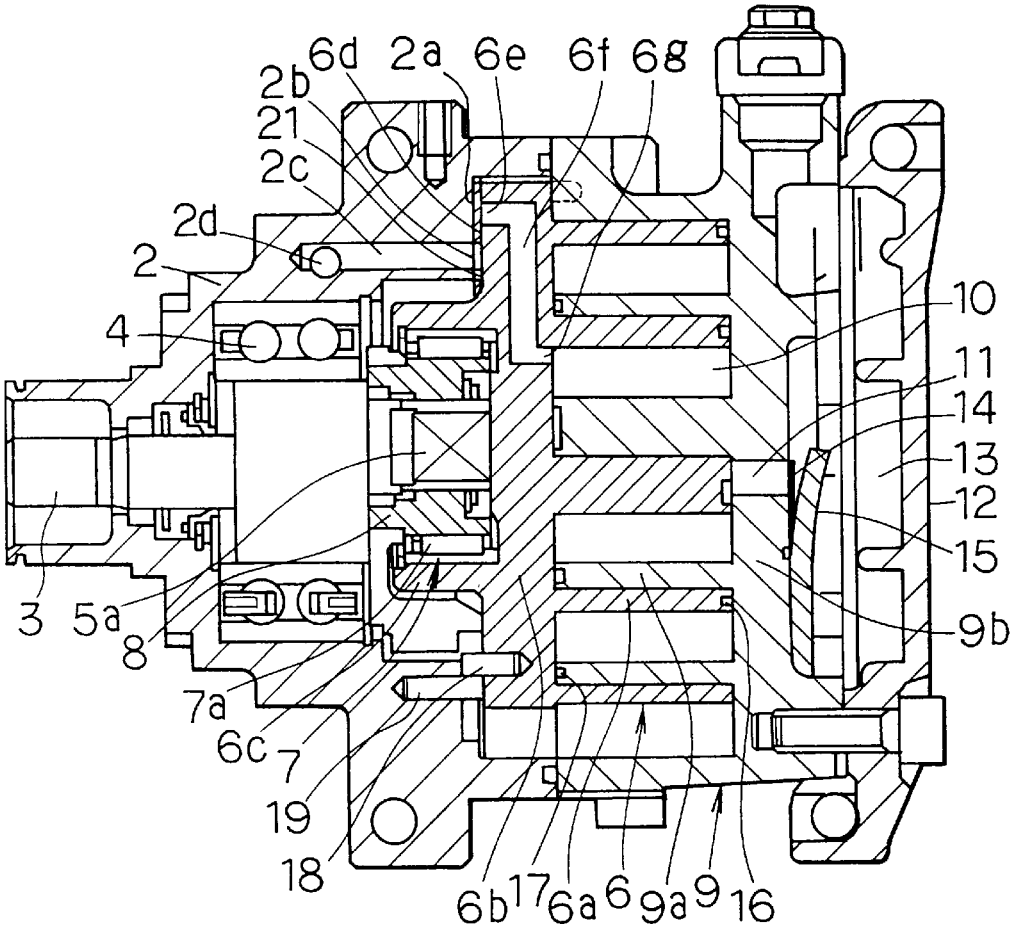
FIG. 2 is a cross sectional view showing a scroll type compressor.
Figure 3:
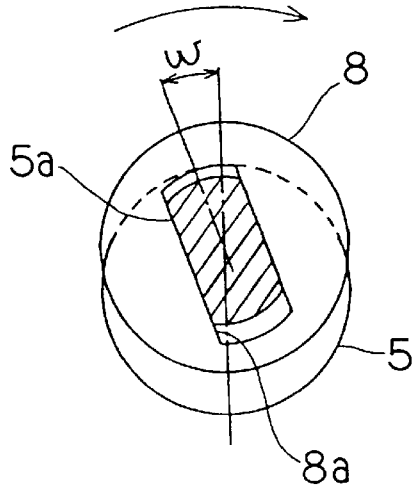
FIG. 3 is a principal view for explaining a slave crank mechanism.

Referring to FIG. 2, the compressor 100 includes a front housing 2, and a bearing 4 provided at the substantial center of the front housing 4 for rotatably supporting a shaft 3. A drive key 5*a* is formed at the rear end of the shaft 3, and the center axis of the drive key 5*a* is eccentric to the center axis of the shaft 3. As shown in FIG. 3, the drive key 5*a* is inserted into a key slot 8*a* formed in a bush 8. Thus, the bush 8 connects to the drive key 5*a* by accommodating the drive key 5*a*. Here, the cross sectional shapes of the drive key 5*a* and the key slot 8*a* have a substantially rectangular shape.

Figure 4:
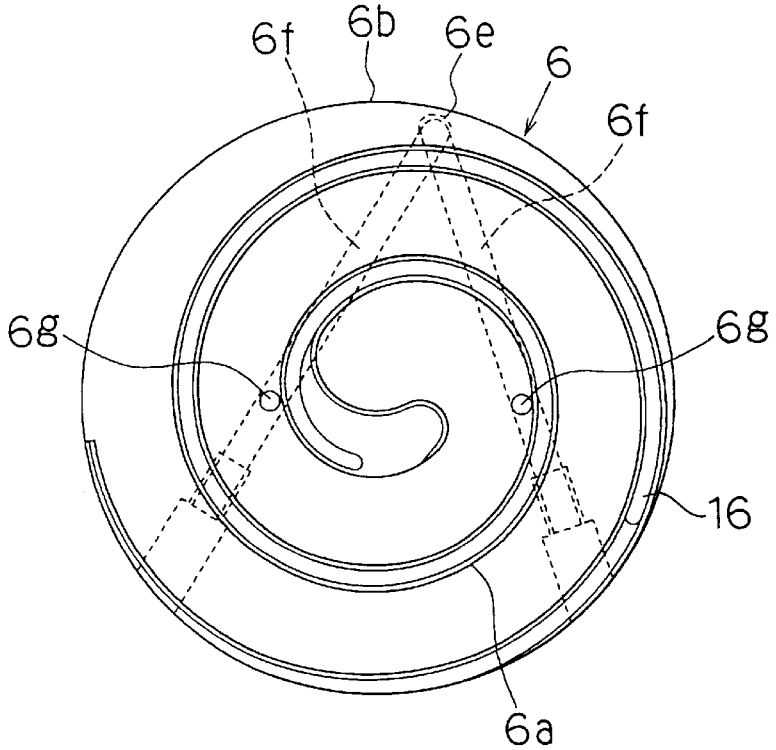
FIG. 4 is a front view showing a movable scroll member.

Turning now to FIG. 4, a movable scroll member 6 has a spiral tooth 6*a*. As shown in FIG. 2, the movable scroll member 6 is provided at the drive key 5*a* side end of the front housing 2. The movable scroll member 6 has a boss portion 6*c*, and a bearing 7 is press inserted into the boss portion 6*c*. The bush 8 is located inside of the bearing 7. Here, the bearing 7 is a shell type needle roller bearing, and the outside peripheral surface of the bush 8 (contacting surface between the bush 8 and the needle roller 7*a* of the bearing 7) functions as an orbit plane of the bearing 7, thereby downsizing the boss portion 6*c*.

The longitudinal dimension of the key slot 8*a* in cross section, as shown in FIG. 3, is a little larger than that of the drive key 5*a*. Thus, the drive key 5*a* is movable with respect to the key slot 8*a* in the longitudinal direction. The longitudinal directions of the drive key 5*a* and the key slot 8*a* are inclined with respect to a line segment connecting the centers of the shaft 3 and the bush 8 in an anti-rotating direction of the shaft 3 (bush 6) by a predetermined angle ω (see FIG. 3).

As above described, a slave crank mechanism 5 is constructed by the drive key 5*a*, the bush 8 and the key slot 8*a*. The slave crank mechanism 5 provides a sealing function in the compression chamber by pushing the spiral tooth 6*a* of the movable scroll member 6 to the spiral tooth 9*a* of a fixed scroll member 9 by using a centrifugal force functioning to the movable scroll member 6.

Referring again to FIG. 2, the fixed scroll member 9 is connected to the front housing 2 with a bolt (not illustrated), and, with the movable scroll member 6*a*, forms the compression chambers 10 where the gas refrigerant is suctioned and compressed.

The movable scroll member 6 orbits around the rotating axis of the shaft 3, with respect to the front housing 2 and the fixed scroll member 9, in the space formed by the fixed scroll member 9 and the front housing 2, and increases/decreases the volume of the compression chamber 10.

The end plate 9*b* of the fixed scroll member 9 includes a discharge port 11 through which the compressed refrigerant is discharged out of the compression chamber 10. The discharge port 11 communicates the compression chamber 10 with the discharge chamber 13 formed by the end plate 9*b* of the fixed scroll member 9 and a rear housing 12.

A discharge valve 14 and a stopper 15 are provided at the discharge port 11. The discharge valve 14 prevents the refrigerant from returning to the compression chamber 10 from the discharge chamber 13, and the stopper 15 defines the maximum opening degree of the discharge valve 14. Tip seals 16, 17 made of resin (for example PPS resin) are installed at the tip ends of the spiral teeth 6*a*, 9*a* of the movable scroll member fixed scroll members 6, 9 respectively.

A plurality of cylindrical scroll side pin members 18 are press inserted around the outer periphery of the end plate 6*b* of the movable scroll member 6. In a similar way, a plurality of cylindrical housing side pin members 19 are press inserted into a surface of the front housing 2 facing the end plate 6*b*. Each housing side pin member 19 is arranged to be offset and is paired with each scroll side pin member 18. These scroll side pin members 18 and housing side pin members 19 form a rotation preventing mechanism which prevents the movable scroll member 6 from rotating around the bush 8. The pin members 18, 19 are made of high rigidity metal superior in abrasion resistance (for example, high carbon chrome bearing steels).

The front housing 2 has a pressure receiving surface 2*a* facing the end plate 6*a* of the movable scroll member 6. The pressure receiving surface 2*a* receives a force in an axial direction of the shaft 3, out of a compression reaction force that activates the movable scroll member 6.

The end plate 6*a* of the movable scroll member 6 has a pressure transmitting surface 6*d* facing the pressure receiving surface 2*a* of the front housing 2. The pressure transmitting surface 6*d* is ground for improving a slide performance between a spacer 21 described hereinafter and the pressure surface 6*a*.

An injection port 2*b* is opened in the pressure receiving surface 2*a* for introducing a medium pressure refrigerant having a pressure between the suction pressure and discharge pressure of the compressor 100. A communication port 6*e*, and a communication passage 6*f* are formed in the pressure transmitting surface 6*d* for communicating the injection port 2*b* with the compression chamber 10. The communication passage 6*f* is, as shown in FIG. 4, divided into two communication passages, and communicates with two injection holes 6*g*. In this way, because two compression chambers, the compressing conditions of which are the same, are formed in a scroll type compressor, two communication passages 6*f* and injection holes 6*g* are needed for injecting the medium pressure refrigerant into these two compression chambers simultaneously.

Figure 5:
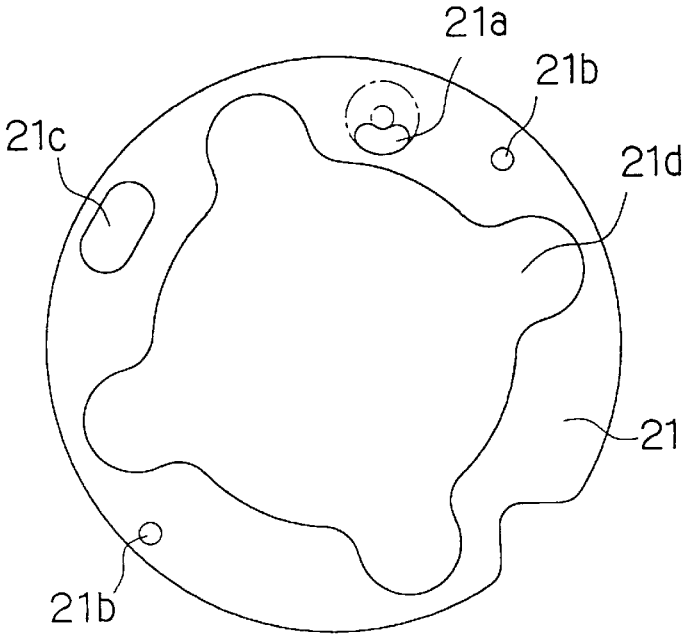
FIG. 5 is a front view showing a spacer.

As shown in FIG. 2, the spacer 21 is provided between the pressure receiving surface 2*a* and the pressure transmitting surface 6*d*. The spacer 21 is made of carbon tool steels (SK material) and fixed to the front housing 2 (pressure receiving surface 2*a*) while contacting both surfaces 2*a*, 6*d*. In the spacer 21, as shown in FIG. 5, a bow-shaped penetration hole 21*a* is press formed at a position corresponding to the injection port 2*b*.

Further, in the spacer 21, insertion holes 21*b*, suction hole 21*c*, and recesses 21*d* are formed. The insertion holes 21*b* are formed for receiving knock pins (not illustrated) of the front housing 2 (pressure receiving surface 2*a*) to set a position of the front housing 2. The spacer 21 is fixed to the front housing 2 (pressure receiving surface 2*a*) by inserting the knock pins into the insertion holes 21*b*. The suction hole 21*c* is formed as a part of a passage communicating the suction port of the compressor with the compression chamber 10. The recesses 21*d* are formed for preventing the spacer 21 from interfering with the rotation preventing mechanism.

In the front housing 2, an injection passage 2*c* is formed for communicating with the injection port 2*b*. The injection passage 2*c* has an inlet opening 2*d* formed on the outside wall of the front housing 2, which abuts the suction port of the compressor 100. A connecting pipe to connect the inlet opening 2*d* to the gas-liquid separator 200, and a connecting pipe to connect the evaporator 600 to the suction port of the compressor 100, are supported and fixed to the front housing 200 by a common supporting member.

In the present embodiment, the communication port 6*e* orbits as well as the movable scroll member 6. Thus, the communication port 6*e* communicates intermittently with the injection port 2*b* in accordance with the orbit of the movable scroll member 6. Therefore, injection timing to inject the medium pressure refrigerant can be easily adjusted by changing the shape or the location of both ports 2*b*, 6*e* or the penetration hole 21*a*.

For example, in the present embodiment, the injection timing (the shape or the location of both ports 2*b*, 6*e* or the penetration hole 21*a*) is set in such a manner that the medium pressure refrigerant is injected when or just after the volume of the compression chamber becomes the maximum volume thereof, i.e., a suction process is completed.

While the compressor 100 operates, because the thrust load due to the compression reaction force functions on the pressure receiving surface 2*a*, the pressure transmitting surface 6*d* and the spacer 21, the surfaces 2*a*, 6*d* and the spacer 21 are hermetically contacted with each other.

Therefore, because the injection port 2*b* and the communication port 6*e* are formed on the pressure receiving surface 2*a* and the pressure surface 6*d* which are hermetically contacted with each other, no gap arises between ports 2*b*, 6*e*. As a result, the medium pressure refrigerant is prevented from leaking to a low pressure side, and a coefficient of performance of the gas-injection type refrigerating cycle is sufficiently improved.

In the present embodiment, because the spacer 21 is provided between the pressure receiving surface 2*a* and the pressure transmitting surface 6*d*, the injection timing can be easily adjusted by changing the shape or the location of the penetration hole 21*a* of the spacer 21. Thus, the shape or the location of the injection port 2*b* and the communication port 6*e* do not need to be changed.

(Modifications)

Figure 6:
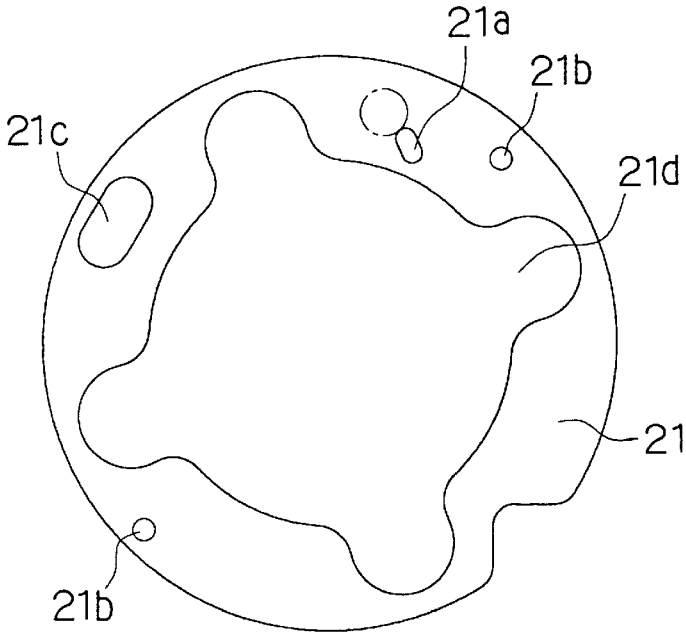
FIG. 6 is a front view showing a modification spacer.

In the above-described embodiment, the penetration hole 21*a* of the spacer 21 is bow-shaped. However, the shape of the penetration hole 21*a* is not limited to a bow shape, and may be an oval (ellipse) shape as shown in FIG. 6.

In the above-described embodiment, the spacer 21 is fixed to the front housing 2. Alternatively, the spacer 21 may be fixed to the movable scroll member 6.

Further, in the above-described embodiment, the spacer 21 is provided between the pressure receiving surface 2*a* and the pressure transmitting surface 6*d*. Alternatively, injection timing can be adjusted by changing the shape or the location of the injection port 2*b* and the communication port 6*e*.

What is claimed is:

1. A scroll type compressor to be applied to a gas-injection type refrigerating cycle, comprising:

a housing;

a fixed scroll member provided in and fixed to said housing;

a movable scroll member provided in said housing and forming a compression chamber with said fixed scroll member, said movable scroll member orbiting with respect to said housing and said fixed scroll member;

a pressure receiving surface formed in said housing and receiving a compression reaction force functioning on said movable scroll member;

an injection port formed in said pressure receiving surface, through which medium pressure refrigerant having a pressure between a suction pressure and a discharge pressure of said compressor is injected;

a pressure transmitting surface formed in said movable scroll member and facing said pressure receiving surface, said pressure transmitting surface transmitting the compression reaction force to said pressure receiving surface;

a communication port formed in said pressure transmitting surface and communicating with said compression chamber, wherein said injection port and said communication port intermittently communicate with each other in accordance with an orbit of said movable scroll member, a spacer provided between said pressure receiving surface and said pressure transmitting surface, said spacer contacting said pressure receiving surface and said pressure transmitting surface, and being fixed to one of said pressure receiving surface and said pressure transmitting surface; and a penetration hole formed in said spacer at a position corresponding to one of said ports formed in said one of surfaces to which said spacer is fixed.

2. A scroll type compressor according to claim 1, wherein said spacer is fixed to said pressure receiving surface, and said penetration hole is formed in said spacer at a position corresponding to said injection port formed in said pressure receiving surface.

3. A scroll type compressor according to claim 1, wherein said medium pressure refrigerant is injected into said compression chamber when a volume of said compression chamber becomes a maximum volume thereof.

4. A scroll type compressor according to claim 1, wherein said medium pressure refrigerant is injected into said compression chamber when a suction process of said compressor is completed.

5. A scroll type compressor according to claim 1, wherein said penetration hole is bow-shaped.

6. A scroll type compressor having a housing, and fixed and movable scroll members mounted in the housing and defining a compression chamber, comprising:

a pressure receiving surface formed within the housing that receives a movable scroll member compression reaction force, and that includes an injection port into which a refrigerant is injected a pressure transmitting surface formed within the movable scroll member that opposes the pressure receiving surface, that transmits the compression reaction force to the pressure receiving surface to form a hermetic seal therewith, and that includes a communication port that intermittently communicates with the compression chamber during rotation of the movable scroll member to allow the injected refrigerant to flow into the compression chamber, and a spacer that spaces the pressure receiving surface and the pressure transmitting surface, the spacer defining a passageway that communicates with one of the ports of the pressure receiving surface and the pressure transmitting surface.

7. The scroll compressor of claim 6, wherein the injected refrigerant has a pressure between a suction pressure and a discharge pressure.

8. The compressor of claim 6, wherein the passage way is bow-shaped.

* * * * *